US005650766A

United States Patent [19]

Burgmann

[11] Patent Number: 5,650,766

[45] **Date of Patent: *Jul. 22, 1997**

[54] WEARABLE TRANSMITTER WITH OPTICAL TAMPER DETECTION

[75] Inventor: Thomas Anthony Burgmann, Mississauga, Canada

[73] Assignee: Detection Systems, Inc., Fairport, N.Y.

[ * ] Notice: The term of this patent shall not extend beyond the expiration date of Pat. No. 5,523,740.

[21] Appl. No.: 427,522

[22] Filed: Apr. 24, 1995

[51] Int. Cl.[6] ..... G08B 1/08

[52] U.S. Cl. ..... 340/539; 340/573; 340/555; 340/568; 340/693; 200/DIG. 2; 200/DIG. 47; 200/DIG. 36

[58] Field of Search ..... 340/539, 573, 340/555, 693, 568; 361/173–177; 200/DIG. 2, DIG. 47, DIG. 36

[56] References Cited

U.S. PATENT DOCUMENTS

| | | | |
|---|---|---|---|
| 4,546,345 | 10/1985 | Naito | 340/542 |
| 4,621,300 | 11/1986 | Summerer | 200/DIG. 2 |
| 4,812,823 | 3/1989 | Dickerson | 340/572 |
| 4,885,571 | 12/1989 | Pauley et al. | 340/573 |
| 5,014,040 | 5/1991 | Weaver et al. | 340/572 |
| 5,298,884 | 3/1994 | Gilmore et al. | 340/573 |
| 5,374,921 | 12/1994 | Martin et al. | 340/539 |
| 5,523,740 | 6/1996 | Burgmann | 340/539 |

*Primary Examiner*—Donnie L. Crosland
*Attorney, Agent, or Firm*—J. Addison Mathews

[57] ABSTRACT

A wearable transmitter assembly includes a housing containing a radio frequency transmitter and tamper detecting circuit that are attached to an appendage of an individual with a buckle and strap. A light emitter and a light sensor are disposed in the housing and extend to the outside of the housing through one or more apertures. The strap includes an embedded optical fiber. Attachment of the housing to the buckle positions the emitter and sensor adjacent the ends of the optical fiber in the strap to complete an optical path or circuit from the emitter around the appendage to the sensor. The housing is sealed closed, including sealant between the emitter, the sensor and the aperture, providing a water tight enclosure for said transmitter from the time of its manufacture. Attachment of the housing to the buckle completes a seal blocking contaminates, such as water, water vapor, and soap from the ends of the optical fiber, the emitter and the sensor.

8 Claims, 6 Drawing Sheets

34
MODEM
COMPUTER
SCHEDULE
36
30
14
PSN
32
22
24
28
12
RECEIVER
MODEM
μ PROCESSOR
SCHEDULE
26
10
16
18
TRANSMITTER
AMP
20
86
μPROCESSOR
88
TAMPER
96
92
38
AMP
DRIVER
SENSOR
94
90
EMITTER
100
42
40

WEARABLE TRANSMITTER WITH OPTICAL TAMPER DETECTION

BACKGROUND OF THE INVENTION

1. Field of Invention

The invention relates to wearable transmitter assemblies for monitoring individuals and more specifically to such an assembly secured with a strap to an appendage of the individual. The invention has particular utility with transmitters in "house arrest" systems including tamper detection features coupled through the strap.

2. Description of the Prior Art

Personal monitoring systems are known to include a wearable transmitter, sometimes called a tag or beacon, that communicates with a field station linked to a monitoring center. In house arrest systems, for example, the presence or absence of an individual is monitored to determine when the individual leaves and returns to a predetermined location, frequently a home. A transmitter on the individual broadcasts a radio frequency signal at relatively low power. A corresponding field station in the home includes a receiver for detecting the signal whenever the transmitter is within range. If the monitored individual leaves the home, the distance from the transmitter to the field station exceeds the range of the system and it loses the signal. Unscheduled signal losses initiate a reporting sequence including notification of an infraction sent to the monitoring center.

The transmitter usually is secured with a strap selected to fit comfortably but snugly around a wrist or ankle of the individual so the transmitter cannot be removed. Tamper circuits in the transmitter housing detect any cutting or removal of the strap that might be associated with unauthorized removal of the transmitter. Tamper information is transmitted to the home receiver and forwarded to the monitoring center. If the transmitter is not within range of the system when the tamper occurs, the tamper signal is stored and transmitted later when communication with the system is reestablished.

PROBLEM SOLVED BY THE INVENTION

Existing transmitter assemblies can be cumbersome to assemble on the wrists or ankles of individuals who are not inclined to provide assistance.

Assemblies that include optical tamper circuits present special problems that are particularly difficult to solve. As will become apparent from the following description, optical interfaces require proper positioning and alignment of the optical elements, and should be protected against contamination carried by the atmosphere and fluids that might contact the assembly. In addition to obvious contaminates like dirt, sand, water and water vapor, Applicant has found that soap products and scum may degrade performance if it is permitted to accumulate at the optical interfaces.

SUMMARY OF THE INVENTION

The present invention is directed to overcoming one or more of the problems set forth above while providing further advantages in wearable transmitter assemblies. Briefly summarized, according to one aspect of the invention, a wearable transmitter assembly includes a housing containing a radio frequency transmitter and tamper detecting circuit that are attached to an appendage of an individual with a buckle and strap. A light emitter and a light sensor are disposed in the housing and extend to the outside of the housing through one or more apertures. The strap includes an embedded optical fiber. Attachment of the housing to the buckle positions the emitter and sensor adjacent the ends of the optical fiber in the strap to complete an optical path or circuit from the emitter around the appendage to the sensor.

According to other features, the housing is sealed closed, including sealant between the emitter, the sensor and the aperture, providing a water tight enclosure for said transmitter from the time of its manufacture. Still more specifically, attachment of the housing to the buckle completes a seal blocking contaminates, such as water, water vapor, and soap from the ends of the optical fiber, the emitter and the sensor. This seal is a resilient member defining a compartment for receiving the emitter and the sensor, and includes first and second opposed holes through the seal for receiving ends of the optical fiber. The seal is compressed by attachment of the transmitter to the buckle, thereby sealing the emitter and sensor compartment closed.

According to other aspects of the invention, the transmitter housing contains a tamper detection circuit including a light emitter and a light sensor supported by the housing. The strap includes an imbedded optical fiber. The buckle supports the optical fiber, the emitter and the sensor to form a light path from the emitter through the fiber to the sensor. This light path will be broken, triggering a tamper signal, by: a) separation of the housing from the buckle, b) separation of the strap from the buckle, or c) severing the strap.

According to the inventive features, the housing is sealed closed at the time of manufacture to protect the transmitter and most of the tamper detection circuit. The emitter and sensor, which project from the housing, are then further protected by a seal that is captured between the housing and the buckle when the housing is assembled on the buckle. The same simple assembly operation also positions and aligns the emitter and sensor relative to the optical fiber in the strap. Attaching the transmitter housing to the buckle and strap completes the optical tamper detection circuit and assures protection of the circuit from contamination.

These and other features and advantages of the invention will be more clearly understood and appreciated from a review of the following detailed description of the preferred embodiments and appended claims, and by reference to the accompanying drawings.

DESCRIPTION OF THE PREFERRED EMBODIMENTS

House Arrest System

Figure 1:
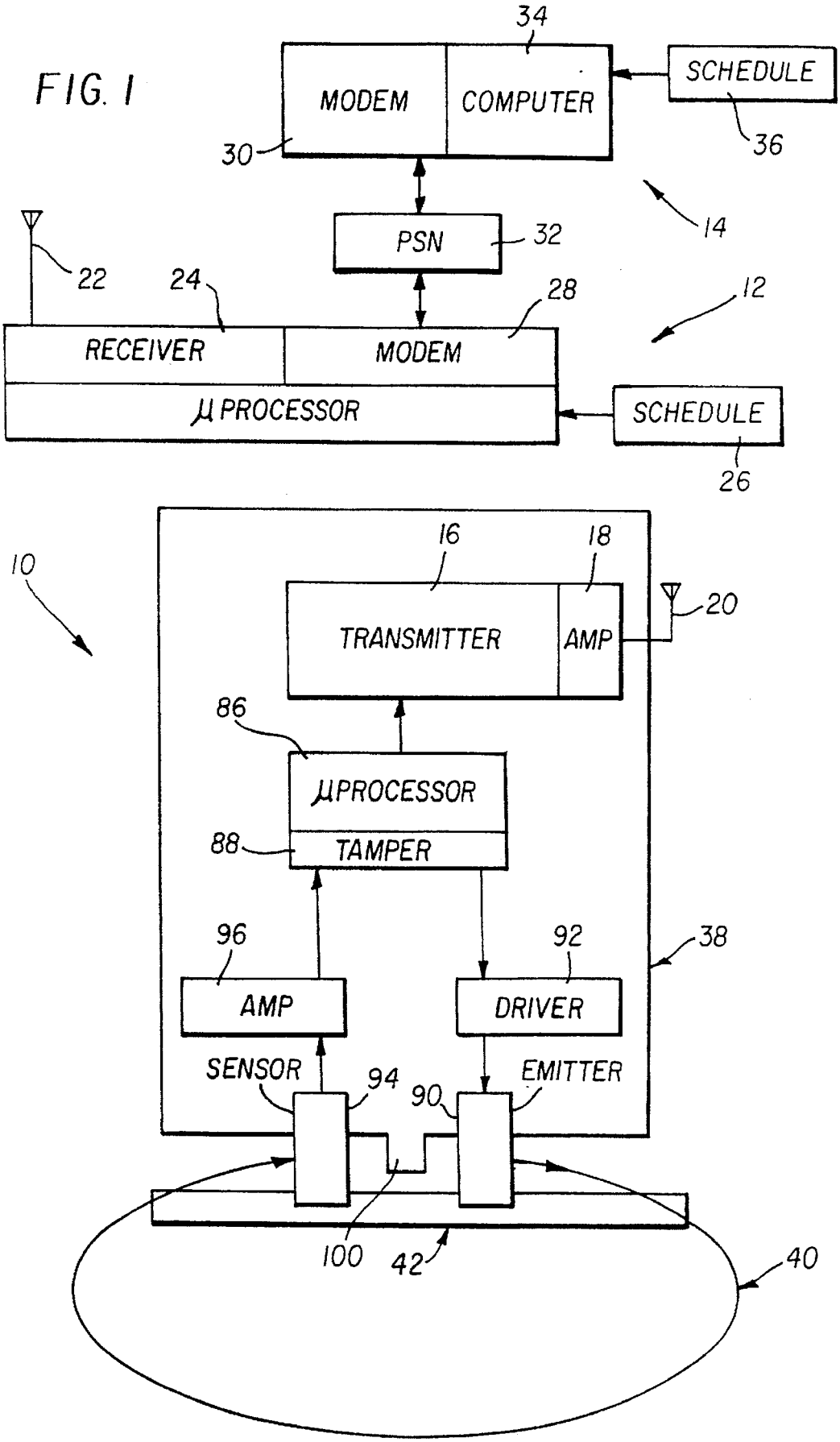
FIG. 1 is a schematic view of a personal monitoring system incorporating a preferred embodiment of the invention, including a wearable transmitter assembly, a field station for receiving signals from the transmitter assembly, and a monitoring center for communicating with the field station.

A house arrest system including a preferred embodiment of the invention is depicted in FIG. 1. The system includes a transmitter assembly 10, home or field station 12 and monitoring center 14. The transmitter assembly 10 is designed for wearing on an appendage, such as a wrist or ankle, and includes a transmitter 16, amplifier 18 and antenna 20 for transmitting a relatively weak radio frequency signal including a transmitter identification. The field station includes an antenna 22 and receiver 24 that monitors an area surrounding the receiver for detecting the transmitter signal. The range of the system is selected to cover a home, for example, so the signal is detected when the individual is home and lost beyond the range of the system when the individual leaves home. The field station also includes memory for storing an approved schedule listing any times when the individual is expected to leave home and return home. If there is an unscheduled loss of the transmitter signal, the field station 12 calls the monitoring center 14 and reports the infraction. In this preferred embodiment, communications between the field station and monitoring center are through modems 28 and 30 and the public switching or phone network 32. Of course radio transmissions or cellular phone service also might be used. The monitoring center includes a computer 34 with a monitor and master schedule 36. It also stores information about the monitored individual, personnel to be notified in case an infraction occurs and an outline of appropriate steps to be taken for different catagories of infractions.

Transmitter Assembly

Figure 8:
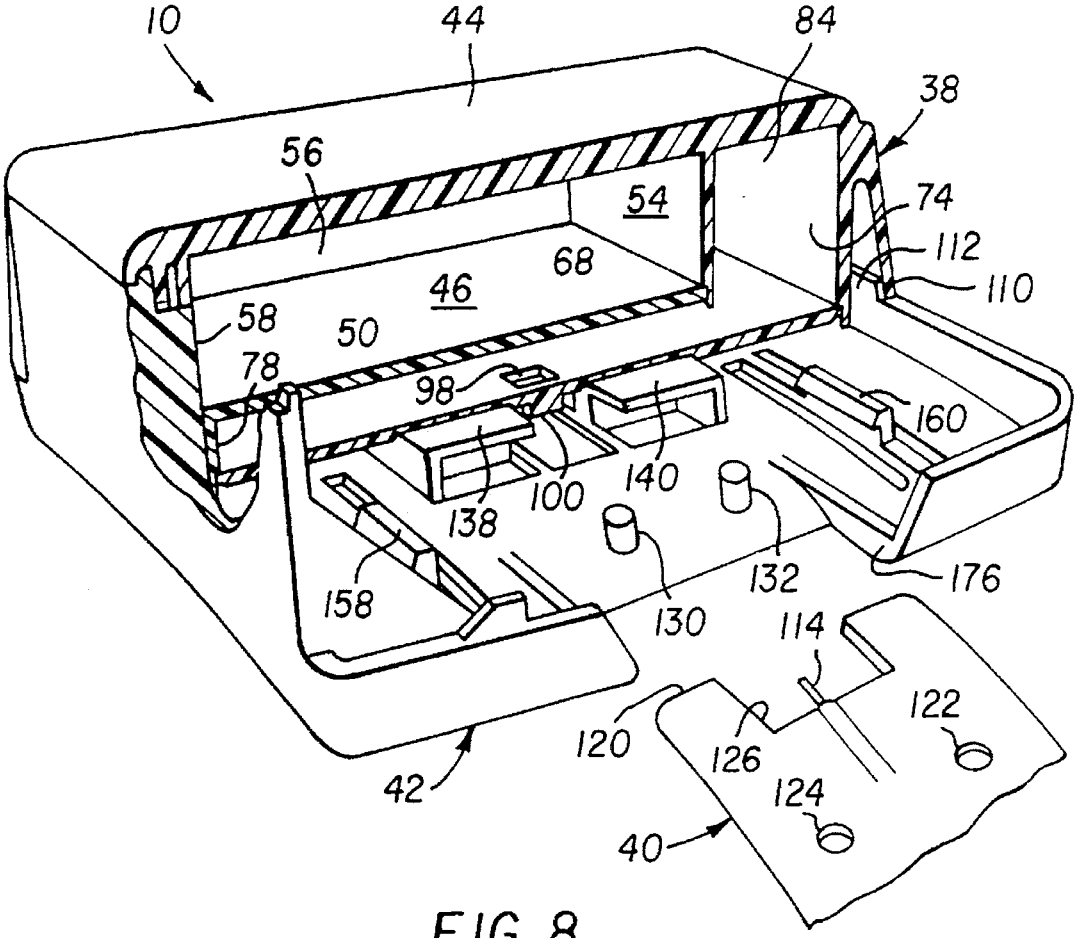
FIG. 8 is a partial perspective view of the wearable transmitter assembly with parts broken away to depict features of the strap, the buckle and the transmitter housing, according to the preferred embodiment.
Figure 9:
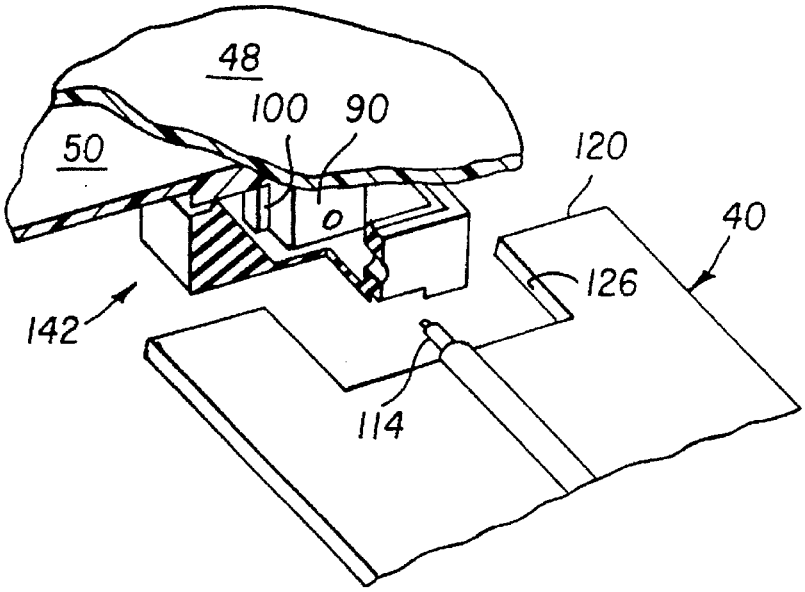
FIGS. 9 and 10 are partial views depicting details of the strap and its relationship to the buckle and tamper detection features supported by the transmitter housing.
Figure 10:
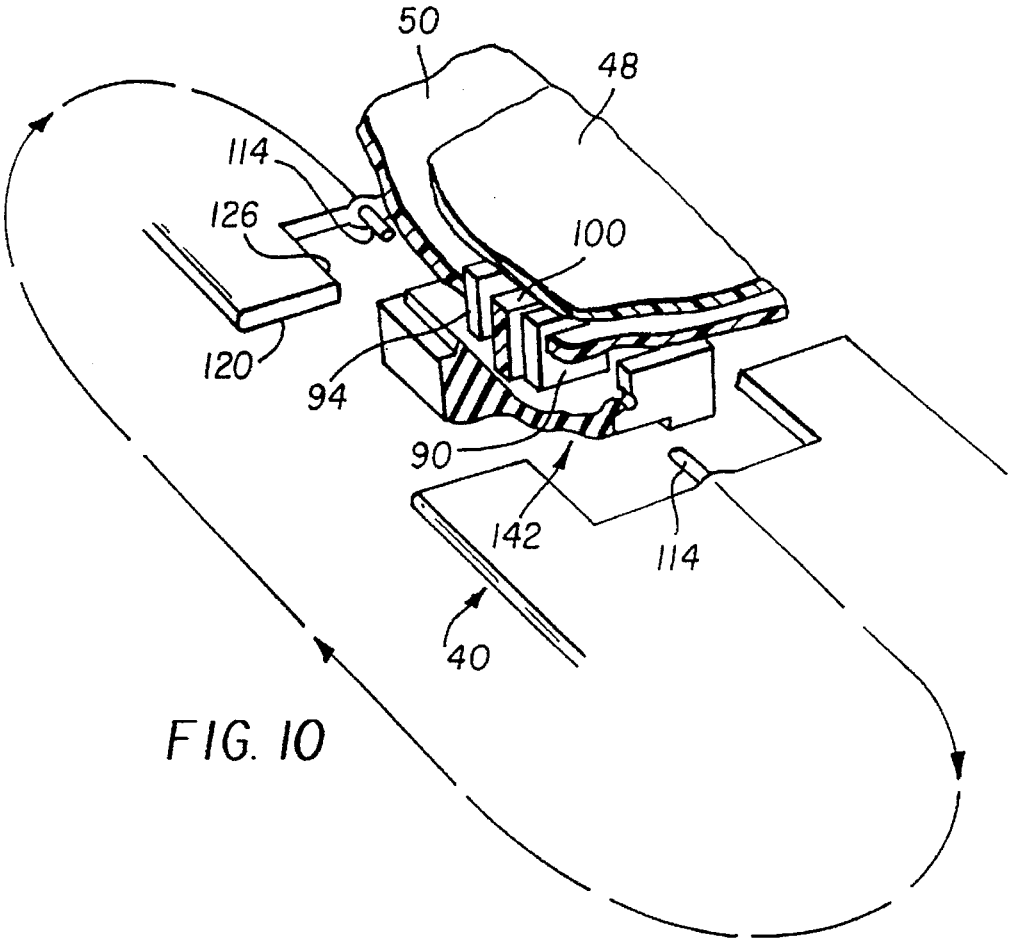

The transmitter assembly 10 (FIG. 8) includes transmitter housing 38, strap 40 and buckle 42, also called a clip.

Transmitter Housing

Figure 2:
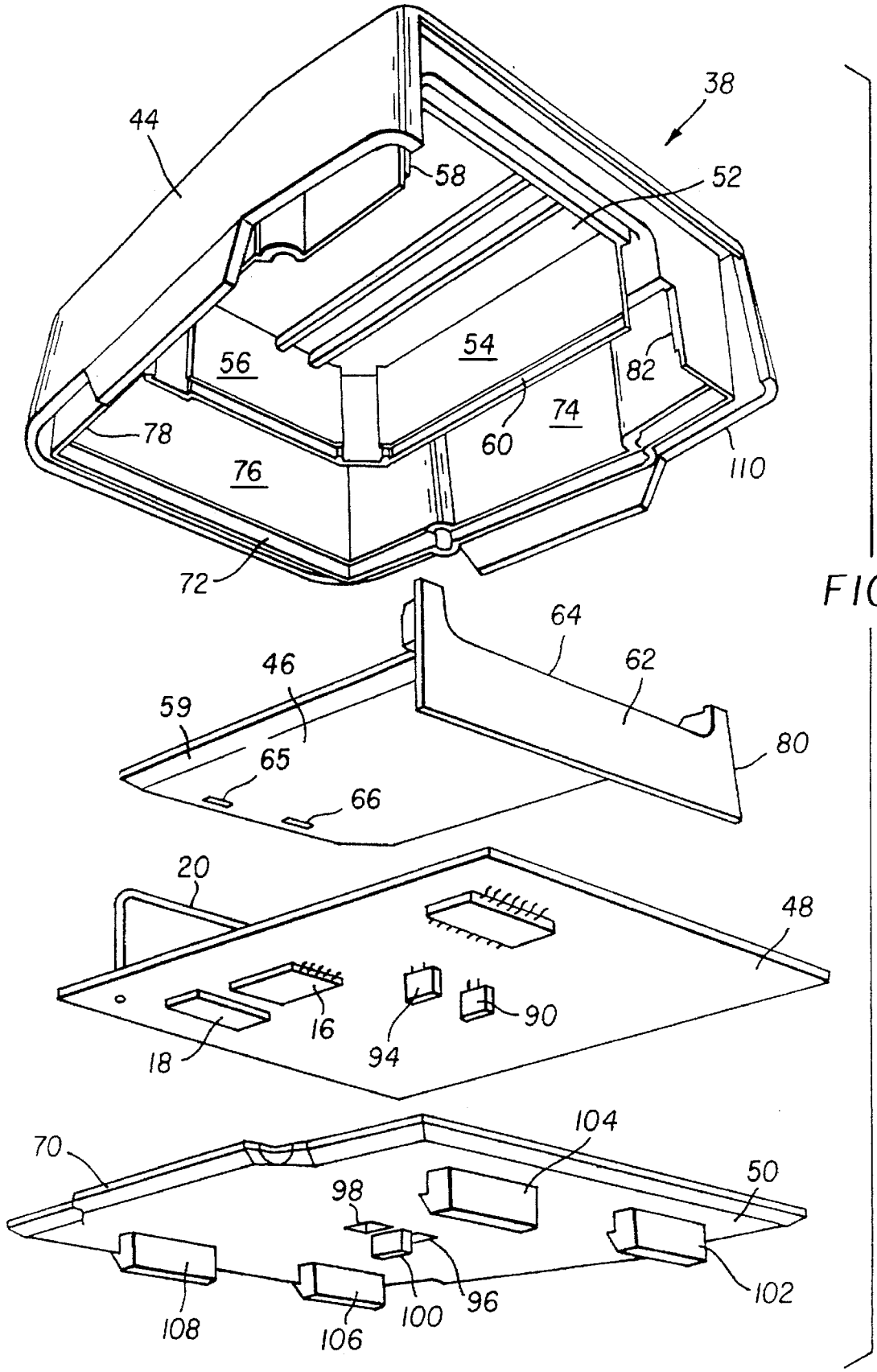
FIG. 2 is an exploded view of the transmitter housing.

The transmitter housing 38 is depicted most clearly in FIG. 2, including a housing cover 44, a battery shield 46, a circuit board 48 and a base plate 50. Housing 38 is adapted to enclose a battery pack (not shown), and the circuit board 48, in a sealed casing that will protect the battery and board from hostile environments including water immersion. The battery is received in a compartment 52 defined between the battery shield 46 and walls 54, 56, and 58, forming an enclosure within housing cover 44. The battery shield 46 is sealed in place during manufacturing with the peripheral edges 59 of the shield received in a recess 60 that extends around the top edges of walls 54, 56 and 58. The end of battery shield 46 includes a perpendicular face plate 62 defining with the housing cover an oval almost rectangular opening 64 that permits battery loading and replacement. The battery pack is moved endwise through opening 64 and into compartment 52, until contacts on the end of the battery pack electrically engage corresponding contacts 65 and 66, extending from the circuit board 48 through shield 46. The battery compartment is then sealed closed by a portion of the buckle 42, as will be described hereinafter.

Circuit board 48 is enclosed by a wall structure in another protected section 68 (FIG. 8), which defines a casing or chamber inside the housing cover 44 between the battery shield 46 and base plate 50. Base plate 50 defines peripheral edges 70 (FIG. 2) that are sealed in a recess 72 extending around the top edges of housing walls 74, 76 and 78. The peripheral edges 80 of face plate 62 similarly are sealed to housing wall 82, enclosing and protecting the circuit board 48. Antenna 20 extends away from the circuit board into an enlarged section or hallway 84 (FIG. 8) between wall 54 of the battery compartment and wall 74 of the transmitter housing.

The circuit board 48 carries a number of items shown most clearly in FIGS. 1 and 2. Already mentioned are the transmitter 16, amplifier 18 and antenna 20. Other items on the board include a microprocessor 86, tamper detection logic or circuits 88, a light emitter 90 and its driver 92, and a light sensor 94 and amplifier 96. Emitter 90 preferably is a light emitting diode (LED) with a side looking window and associated optics focusing light at right angles to the diode or parallel to the circuit board. When energized by driver 92, the diode emits light at predetermined wavelengths preferably in the visible region of the spectrum, preferably around 660 nanometers. Of course infrared and other wavelengths also could be used. Sensor 94 is a photodetector sensitive to the same wavelengths generated by the emitter 96, and preferably is a PIN photodiode detector with a side looking window and associated optics. The microprocessor 86 and tamper circuits 88 drive the emitter 90 to pulse on for predetermined intervals preferably having a duration of fifty to one hundred microseconds (50–100 μs) every one second. The microprocessor 86 and tamper circuits 88 also check the signal from sensor 94 during at least the same intervals, looking for input signals at amplifier 96 that match the emitter output signals.

The emitter 90 and sensor 94 are suspended from the circuit board 48 in back-to-back relation, with the side looking window and associated optics having a field of view pointing away from each other. The emitter 90 and sensor 94 are spaced apart slightly, and extend from adjacent the circuit board 48 through first and second apertures 97 and 98 in the base plate 50 to predetermined oppositely looking positions below the base plate. Appropriate pliant material is provided at the apertures 96 and 98 to seal any space between the base plate 50, the emitter 90 and sensor 94. A separator 100 extends from the base plate 50 between the apertures 96 and 98 to help support the emitter 90 and sensor 94 and to block stray light from passing directly to the sensor from the emitter.

Also extending from the bottom of the base plate 50, are latches 102, 104, 106, and 108, for attaching the transmitter assembly to the buckle. The latches apply a resilient force pulling the transmitter housing 44 and buckle 42 together, while an outer edge 110 on the housing mates with a lip 112 (FIG. 8) on the buckle to align and position one relative to the other, as will be described more fully hereinafter.

The transmitter housing described above is assembled and sealed during manufacture to produce a unitary assembly closed to the environment. While the battery compartment is open at one end for loading and removing the battery, the battery shield isolates the battery compartment from the sections of the housing that contain the circuit board.

Strap

Figure 3:
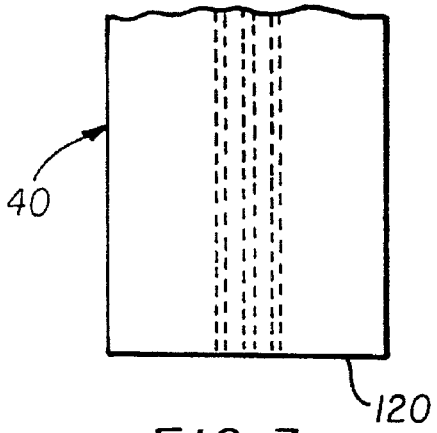
FIG. 3 is a partial top view of a strap for securing the transmitter assembly of FIG. 1 to an appendage according to the preferred embodiment.
Figure 4:
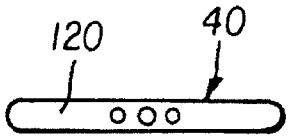
FIG. 4 is an end view of the strap depicted in FIG. 3.
Figure 5:
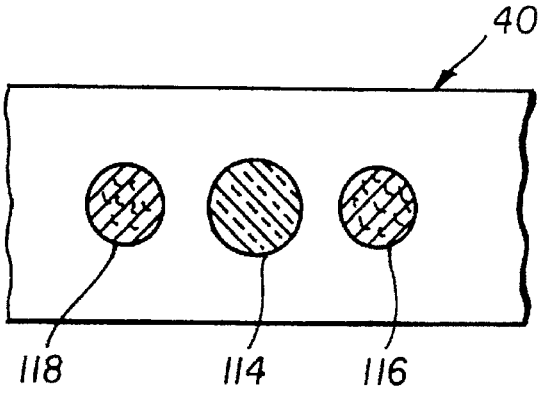
FIG. 5 is an enlarged partial end view of the strap of FIG. 3 depicting optical and non-stretch fibers embedded in the strap.
Figure 6:
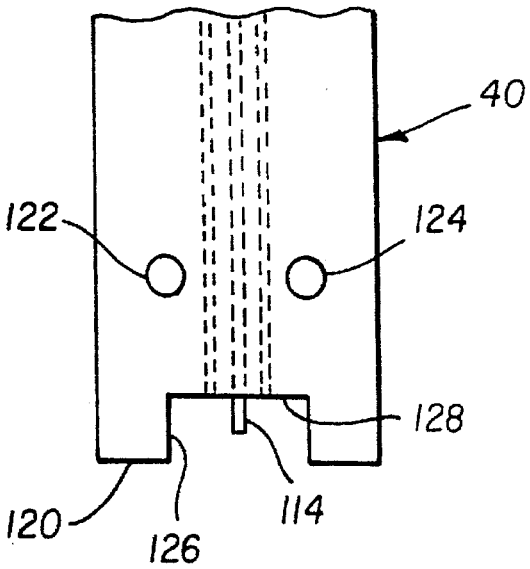
FIG. 6 is a top end view of the strap of FIG 3, depicting a notch for mating with other components of the transmitter assembly.

Strap 40 is illustrated most clearly in FIGS. 3–6. FIGS. 3–5 show the strap as a continuous, one piece band that is manufactured and rolled into a bulk supply of fifty to one hundred feet. FIG. 6 depicts the strap after it is cut and the ends trimmed for attachment to the buckle 42.

Although many materials and configurations might be appropriate for the strap 50, the preferred embodiment is a flexible plastic material such as a polyester elastomer sold under the name Dupont Hytrel approximately one inch wide and one tenth of an inch thick. Three fibers are embedded in the strap running the entire length of the strap. One fiber, in the center of the strap, is an optical fiber 114 having a diameter less than the thickness of the strap. The other two fibers 116 and 118 are a thermally inelastic and non-stretchable material, such as a fiber sold under the name Dupont Kevlar, spaced on opposite sides of the optical fiber. Other non-stretchable materials might include wires or glass strands. Although the strap material is not easily stretched, it is thermoplastic, and the addition of the thermally inelastic strands add security against stretching under aggravated conditions that might include heat.

When the strap is used for mounting a transmitter assembly on an appendage of an individual, it is pulled from the bulk supply and cut to length. The length is measured by encircling the appendage so it fits comfortably, but snugly, with no overlap, and cutting the strap from the supply to form opposite ends 120. This provides a strap length slightly larger than the outer dimensions or circumference of the appendage.

After the strap is cut to length, holes 122 and 124 are formed, preferably by punching, approximately half of an inch, or slightly more, from the end 120 and approximately one quarter of an inch on each side of the optical fiber. A recess or notch 126 also is removed from the end of the strap, defining bifurcated end sections extending on opposite sides of the notch and revealing or exposing the end of the optical fiber 114, which extends into the notches laterally between the bifurcated extensions. The notch is approximately one half of an inch wide and one eighth of an inch deep. The optical fiber 114 is shortened slightly, but still extends beyond the end 128 of notch 126.

When the strap is used to secure a transmitter to an individual, the optical fiber will transmit light signals through the band from one end to the other.

Buckle or Clip

Figure 7:
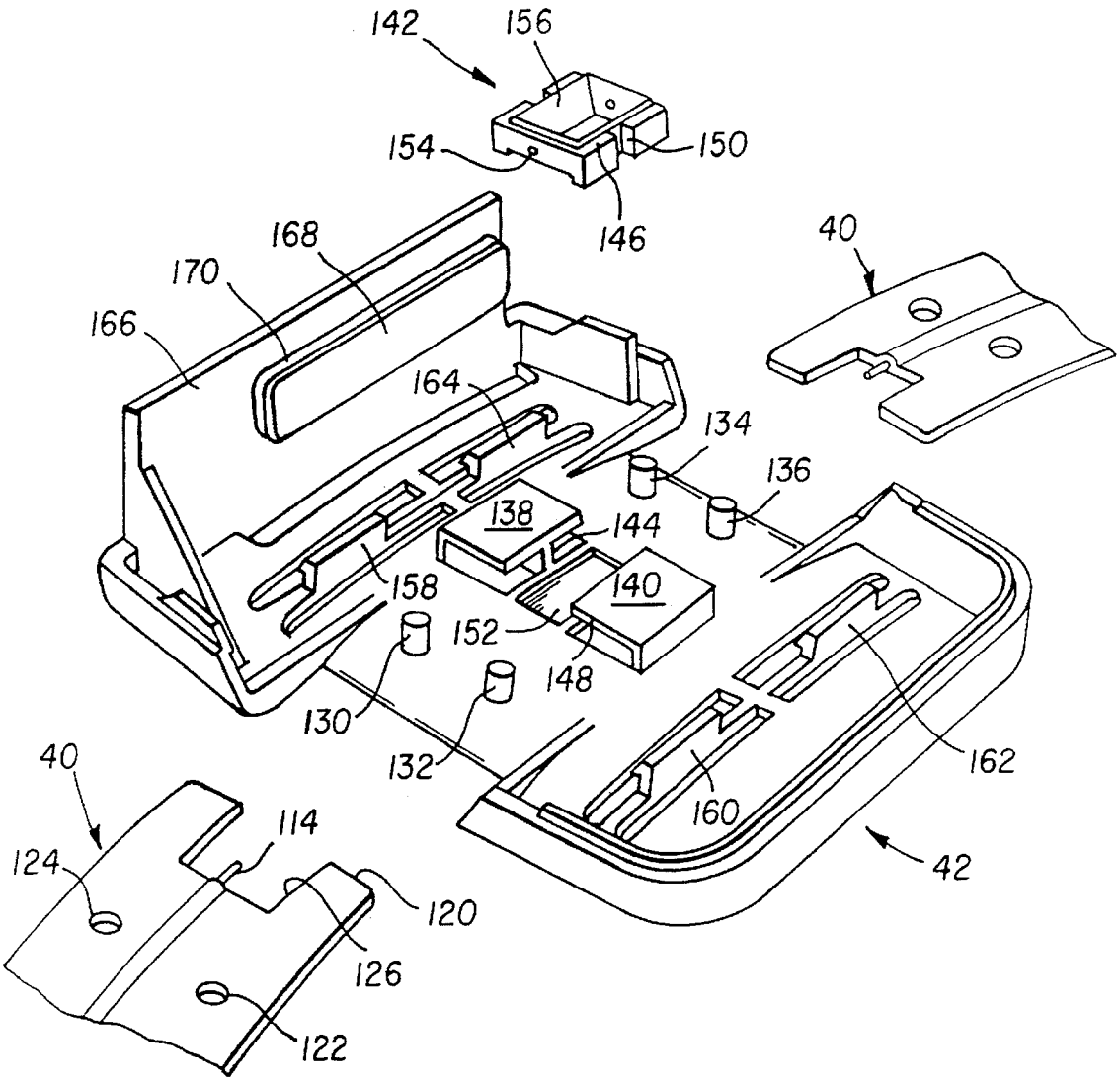
FIG. 7 is a perspective view depicting features of the buckle forming part of the transmitter assembly.

Buckle 42 is illustrated most clearly in FIG. 7, including a first side (not shown), that is smooth and slightly curved to fit comfortably against a wrist or ankle, and a second side depicted in FIG. 7. The buckle is a unitary frame that is thin and light weight including a first set of features for attaching the strap to the buckle independently of the transmitter housing, and a second set of features that receives the transmitter housing, properly locating the housing relative to the strap.

The first set of features include pins or posts 130, 132, 134, & 136, and constraints or cages 138 and 140. The pins have a diameter approximately the same as the strap holes 122 and 124. The cages locate a gasket seal 142 between the cages and receive the bifurcated ends of the strap 40 under the cages, holding the bifurcated ends down against the flat portion of the buckle and also holding the strap with holes 122 and 124 on the posts 130, 132, 134, and 136. Each cage 138 and 140 is divided by a column divider 144, separating each cage into two parts: a first part for receiving a first end of the strap and a second part for receiving the second end of the strap. The column 144 is thin, so it adds very little to the combined length of the strap and buckle when the strap is attached to the buckle. As described above, the strap is cut after measuring the length on the appendage of the individual that will wear the transmitter assembly. When the strap is attached to the buckle, the ends 120 of the strap 40 are separated by only a small amount, slightly greater than the width of column 144, and less than three eighths of an inch. Thus, the strap and buckle together define a length or circumference that is only slightly larger, not more than approximately three eighths of an inch, than the length of the strap alone. This slight increase accommodates the thickness of the buckle between the appendage and the strap.

The cages 138 and 140, and the columns 144, also capture and locate the gasket 142, with a lip 146 under ledge 148, with notch or recess 150 around column 144, and with the bottom of the gasket in a depression 152. The gasket is shaped with a width slightly smaller than the strap notch 126 so the bifurcated ends of the strap straddle the gasket. The gasket is made of a resilient material sealing the ends of the optical fiber 114, which project through holes 154 in the gasket to an interior protected compartment 156. This compartment 156 is closed when the transmitter housing is attached to the buckle, and protects the optical interfaces between the ends of the optical fiber 114, the emitter 90 and the sensor 94 from contamination.

The second set of buckle features, for receiving the transmitter housing, include latches 158, 160, 162, and 164, and the lip 112 around the outside edges of the buckle. The latches 158, 160, 162, and 164 are arranged and located to receive the corresponding latches 102, 104, 106 and 108 of the transmitter base plate 150, latching and resiliently pulling the transmitter housing 44 toward the buckle. The transmitter housing is aligned on the buckle 42 by engagement between the edges 110 of the housing 44 and the lip 112 of the buckle. Such orientation positions the emitter 90 and sensor 94 in predetermined positions inside compartment 156 of seal 142, and properly aligned relative to the ends of the optical fiber 114. Light from the emitter 90 is then coupled through the optical fiber 40 to the sensor 94.

Positioning of the transmitter housing on the buckle also closes the battery compartment 52. Face plate 166 extends perpendicular from the base of the buckle to extend over the opening 64 in the battery compartment 52. Protrusion 168 is slightly smaller than the opening, engaging the battery, while ring seal 170 seals the opening.

Skirts 172 and 174 (FIG. 2) extend over the strap 40, where the strap enters the buckle 42, assisting bending of the strap into recesses 176 and 178 (FIG. 7) in the buckle and around the appendage.

Assembly And Method

In use the transmitter assembly is supplied in three parts (not including the battery): the transmitter housing 44, the strap 40 and the buckle 42. The strap 40 is supplied in bulk on fifty or one hundred foot rolls and is cut to length for each individual. The strap is fit around the intended appendage, such as a wrist or ankle, and is cut to fit comfortably but snugly around the appendage with no overlap. The ends of the strap are then notched and punched as described above.

Figure 11:
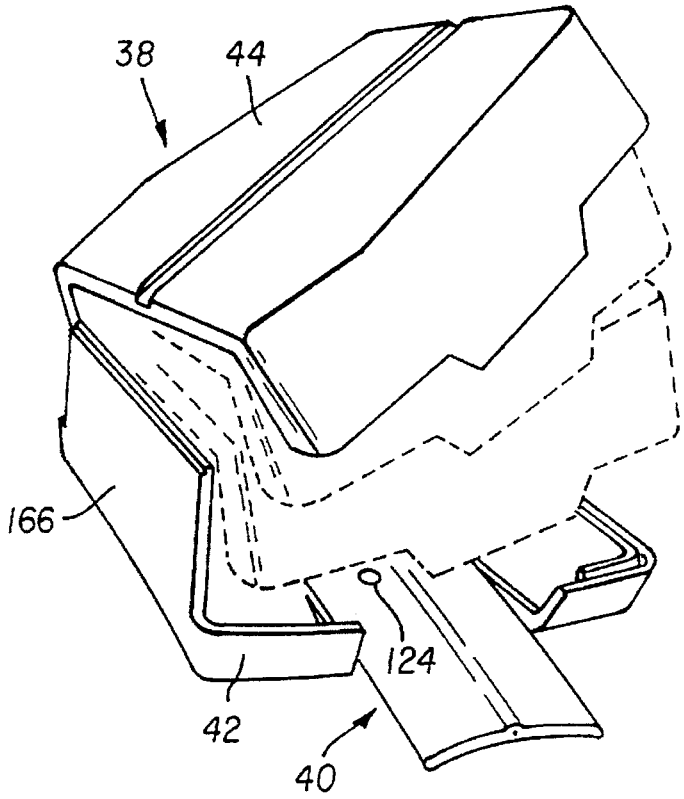
FIG. 11 is a perspective view depicting the assembly of the transmitter housing on the buckle, covering the ends of the strap.

After the strap is cut to length, it is attached around the appendage and to the buckle 42. As already described, the strap 40 and buckle 42 include features permitting their attachment to the appendage without the transmitter housing. After the strap and buckle are attached, the transmitter housing is added as depicted in FIG. 11, by engaging one one end near the battery housing and pivoting the housing into position on the buckle. The latches and cooperating features of the housing 44 and buckle 42 locate the elements supported by the transmitter housing in proper position and orientation relative to corresponding elements of the buckle 42 and strap 40. The emitter 90 and sensor 94, for example, are positioned adjacent the ends of the optical fiber 114 in compartment 156 of gasket 142. The transmitter housing covers the features that attach the strap to the housing, rendering the fasteners inaccessible to the individual wearing the transmitter assembly.

Summary and Conclusion

It should now be apparent that the buckle serves several functions. It holds the strap around an appendage of an individual, even before the transmitter housing is attached. It receives the transmitter housing, and establishes the relative positions of the strap and the housing, particularly the ends of the strap, the emitter and the sensor. It protects the emitter, the sensor and the ends of the optical fiber where it is optically coupled to the emitter and sensor. The buckle receives the transmitter housing in a manner that covers the strap fasteners, rendering the points of attachment inaccessible to the wearing individual. And it supports the optical fiber, the emitter and the sensor to form a light path from the emitter through the fiber to the sensor. This light path is broken, and triggers a tamper signal, by any of the following events: a) separation of the housing from the buckle, b) separation of the strap from the buckle, or c) severing the strap.

The invention also facilitates fitting of the transmitter assembly on an appendage of an individual first by cutting the strap to length measured on the appendage, then by attaching the strap and buckle on the appendage and finally by clipping the transmitter housing to the buckle. This method also provides for supplying the strap in and cutting the strap from a bulk roll.

While the invention is described in connection with a preferred embodiment, other modifications and applications will occur to those skilled in the art. The claims should be interpreted to fairly cover all such modifications and applications within the true spirit and scope of the invention.

PARTS LIST FOR FIGURES

| Reference No. | Part |
|---|---|
| 10. | Transmitter assembly |
| 12. | Field station |
| 14. | Monitoring center |
| 16. | Transmitter |
| 18. | Amplifier |
| 20. | Antenna |
| 22. | Antenna |
| 24. | Receiver |
| 26. | Schedule |
| 28. | Modem |
| 30. | Modem |
| 32. | Phone network |
| 34. | Computer |
| 36. | Master schedule |
| 38. | Housing |
| 40. | Strap |
| 42. | Buckle or clip |
| 44. | Housing cover |
| 46. | Battery shield |
| 48. | Circuit board |
| 50. | Base plate |
| 52. | Battery compartment |
| 54, 56 & 58. | Compartment walls |
| 59. | Peripheral edge |
| 60. | Recess |
| 62. | Face plate |
| 64. | Opening |
| 65. | Battery contact |
| 66. | Battery contact |
| 68. | Circuit board section |
| 70. | Peripheral edge |
| 72. | Recess |
| 74, 76, & 78. | Walls |
| 80. | Peripheral edges |
| 82. | Housing wall |
| 84. | Hallway |
| 86. | Microprocessor |
| 88. | Tamper circuit |

-continued

PARTS LIST FOR FIGURES

| Reference No. | Part |
|---|---|
| 90. | Emitter |
| 92. | Driver |
| 94. | Sensor |
| 96. | Amplifier |
| 97. | Aperture |
| 98. | Aperture |
| 100. | Separator |
| 102, 104, 106, & 108. | Latches |
| 110. | Edge |
| 112. | Lip |
| 114. | Optical fiber |
| 116, 118. | Non-stretchable fiber |
| 120. | Ends |
| 122, 124. | Holes |
| 126. | Notch |
| 128. | End of notch |
| 130, 132, 134 & 136. | Pins or posts |
| 138 & 140. | Cages |
| 142. | Gasket |
| 144. | Column divider |
| 146. | Lip |
| 148. | Ledge |
| 150. | Recess or notch |
| 152. | Depression |
| 154. | Holes |
| 156. | Interior compartment |
| 158, 160, 162 & 164. | Latches |
| 166. | Face plate |
| 168. | Protrusion |
| 170. | Ring seal |
| 172 & 174. | Skirts |
| 176 and 178. | Recesses |

What is claimed is:

1. A transmitter assembly including a housing containing a radio frequency transmitter and circuit board, a strap defining first and second ends, and a buckle for attaching the strap and housing to an appendage of an individual; characterized in that:

said housing defines at least one aperture, a light emitter and a light sensor are disposed on said circuit board projecting through said at least one aperture, said strap includes an optical fiber running through said strap from said first end to said second end, said buckle aligns said first and second ends in first and second predetermined positions relative to said buckle, and attachment of said housing to said buckle positions said emitter and sensor in said first and second predetermined positions, in optical communication with said first and second ends respectively, completing an optical path from said emitter through said optical fiber to said sensor.

2. The invention of claim 1, wherein said housing is sealed closed, including sealant between said emitter, said sensor and said at least one aperture, to provide a water tight enclosure for said transmitter.

3. The invention of claim 2, wherein said attachment of said housing to said buckle completes a seal blocking contaminates from said optical communication between said first and second ends of said optical fiber and said emitter and sensor, respectively.

4. The invention of claim 3, wherein said seal is a resilient member defining a compartment for receiving said emitter and said sensor, first and second opposed holes through said seal to said compartment for receiving first and second ends of said optical fiber, respectively, and a lip compressed by attachment of said transmitter to said buckle, thereby sealing said compartment closed.

5. The invention of claim 1, wherein said emitter is disposed closely adjacent said sensor on said circuit board, and said emitter and sensor are disposed in back-to-back relationship, with directions of view one hundred and eighty degrees apart parallel to said circuit board.

6. A transmitter assembly including a tamper detection circuit and attachable to a buckle for completing said circuit optically around an appendage of an individual; said assembly comprising:

a housing defining a chamber and a side of said housing having at least one aperture from said chamber through said side;

means supporting said tamper detection circuit in said chamber, said tamper detection circuit including a light emitter and a light sensor projecting through said at least one aperture in said housing side;

means for sealing said chamber closed against water, including said at least one aperture; and, means on said side of said housing for pivoting said housing into latched position on the buckle, said pivoting completing said circuit optically from said emitter around the appendage to said sensor.

7. A transmitter assembly wearable on an appendage of an individual and comprising:

a housing defining a chamber and at least one aperture from said chamber through said housing;

a tamper detection circuit in said chamber, said tamper detection circuit including a light emitter and a light sensor extending through said at least one aperture in said housing;

means for sealing said chamber closed against water, including said at least one aperture;

a strap including first and second ends and an optical fiber running through said strap from said first end to said second end; and, a buckle including a) locating means independent of said housing for locating said first and second ends in first and second predetermined positions on said buckle, and b) fastening means for securely fastening said transmitter to said band with said optical fiber completing an optical circuit between said emitter and said sensor.

8. The invention of claim 7, wherein said emitter is supported closely adjacent said sensor, and said emitter and sensor are disposed in back-to-back in oppositely facing relationship.

* * * * *